US005735633A

United States Patent [19]

Metzger

[11] Patent Number: 5,735,633

[45] Date of Patent: *Apr. 7, 1998

[54] METHOD OF AND DEVICES FOR SEALING AND SUPPORTING CONCRETE FLOOR JOINTS AND THE LIKE

[76] Inventor: Steven N. Metzger, P.O. Box 2391, Concord, N.H. 03302-2391

[ * ] Notice: The term of this patent shall not extend beyond the expiration date of Pat. No. 5,690,447.

[21] Appl. No.: 647,530

[22] Filed: May 15, 1996

Related U.S. Application Data

[62] Division of Ser. No. 293,795, Aug. 22, 1994, abandoned.

[51] Int. Cl.[6] ..... E01C 11/10

[52] U.S. Cl. ..... 404/65; 52/396.06

[58] Field of Search ..... 404/47, 49, 64, 404/65, 69, 66, 67, 68; 52/396.04, 396.06

[56] References Cited

U.S. PATENT DOCUMENTS

| | | | |
|---|---|---|---|
| 3,124,047 | 3/1964 | Graham | 404/47 |
| 3,479,933 | 11/1969 | Hall | 404/67 |
| 4,127,350 | 11/1978 | Weber | 404/65 |
| 4,285,612 | 8/1981 | Betti | 404/68 |
| 4,290,249 | 9/1981 | Mass | 404/68 X |
| 4,784,516 | 11/1988 | Cox | 404/69 |
| 5,168,683 | 12/1992 | Sansom et al. | 404/68 X |

FOREIGN PATENT DOCUMENTS

| | | | |
|---|---|---|---|
| 286295 | 9/1966 | Australia | 404/64 |
| 562035 | 5/1957 | Italy | 404/64 |
| 318387 | 7/1969 | Sweden | 404/64 |

*Primary Examiner*—James Lisehora
*Attorney, Agent, or Firm*—Rines and Rines

[57] ABSTRACT

A novel technique and seal-and-filling support for longitudinally extending concrete floor joints comprising a resiliently compressible cylindrical support member of cross-dimension similar to or lesser than the joint opening and compressibly inserted into the joint to seal the base thereof and to support thereupon and there along a semi-rigid epoxy filling the joint above the support and up flush to the concrete floor, and with the support having external longitudinally extending ribs or fins, and having hardness substantially matched to that of the epoxy filler.

5 Claims, 1 Drawing Sheet

METHOD OF AND DEVICES FOR SEALING AND SUPPORTING CONCRETE FLOOR JOINTS AND THE LIKE

This application is a division of patent application Ser. No. 08/293,795, filed Aug. 22, 1994, now abandoned.

The present invention relates to the sealing of joints or cuts deliberately formed in concrete and similar floors (sawed joints or cuts, bulkhead construction joints, keyed joints, etc.,) for such purposes as confining the cracks that inherently develop during the curing of the concrete, substantially to the regions below the joints or cuts; the invention being more particularly directed to the support of semi-rigid epoxy fillings for such joints against which vehicle wheels of carts, forklifts or other apparatus apply pressure, during their use on the floors of factories, plants, offices and the like, which tends to depress the fillings and expose the floor joint or cut edges to chipping.

BACKGROUND OF INVENTION

Caulking and sealants have been copiously used for filling openings, cracks and joints in a myriad of applications in the construction field. The term caulking, (calking), indeed, comes from the days of the old wooden ships, when the joints between the wooden boards were caulked, usually with a bituminous type of material, to seal the void from water entry. A jute-type backing material was first pounded into the void under compression, followed by the caulking.

In the early-to-mid 1900's, jute continued to be used with and under newer types of caulk, such as oil-based caulks. In the 1950's, elastomeric type sealants came onto the market (Thiokol polysulfides, silicones, etc). These "sealants", unlike the old "caulks", had the ability to expand and contract with the joints as the joints moved due to temperature variations. The amount of movement capability was determined by the flexibility potential of the sealant before adhesion or cohesion failure, and by the width-depth ratio at which the sealant was installed. Such elastomeric sealants offered maximum movement when installed in a ratio of 2×width by 1×depth. To help achieve this depth, backer rods were inserted into the joint. Among such were the Dow "Ethafoam"®—a foamed polyethylene—which was very compressible and could be easily inserted into joints. The only function of such inserts and backer rods was solely to control the depth of the sealant to be installed.

Semi-rigid epoxy "fillers" were specifically and exclusively developed for joints in concrete floor slabs subject to hard-wheeled traffic (forklifts, etc.) as before described. Among such are the MM-80 and Polar Fill, epoxys marketed by the assignee of the present invention; such, while much akin to the typical caulking or sealant applications, differing in the respect that accommodating joint movement is not a problem in such floors. Thus the width-depth ratio is irrelevant. In concrete floors and the like, indeed, the problems are quite different from other sealing applications, including walls and ceilings. The problem rather is to refill the intentionally cut or created joint in a way that restores the continuity of the floor surface and provides support for the top edges of the joint from hard wheel traffic.

The present invention is thus concerned with providing an improved seal and filling support device for concrete floor joints that provides multi-functional and synergistic improvement in several areas not heretofore individually attained, and certainly not in total combination. The invention embraces a novel resilently compressible tubular support device, preferably with longitudinally extending ribs serving as fin wipers, for initially compressively protecting the joint from contaminating materials during construction, and then for insertion to seal the base of the joint while wiping clean the sidewalls thereof, and to receive and support the epoxy filling of the joint thereupon, preventing epoxy loss through the base or bottom of the joint and supporting the epoxy filler from depressing in response to vehicle wheel traffic and the like across the joint. Unlike sand depth guessing and other disadvantages of prior techniques, the invention is fast, simple and universally applicable for floor joint systems.

OBJECTS OF THE INVENTION

The principal object of the invention, therefore, is to provide a new and improved sealing and filling support device for concrete floor joints and the like, and improved filled joints resulting from the method of application and use of the device, obviating the above-described and other disadvantages of prior techniques.

Other and further objects will be discussed hereinafter and are more particularly delineated in the appended claims.

SUMMARY

In summary, however, from one of its aspects, the invention embraces a seal and filling support device for longitudinally extending concrete floor joints and the like of predetermined opening cross-dimension, comprising a resiliently compressible cylindrical support member of cross-dimension similar to or lesser than said opening cross-dimension, longitudinally ribbed to provide compressible joint-wall wiping fins.

The use of the device is effected by a method of sealing and supporting fillings in concrete floor joints and the like, that comprises, during floor construction and preparation, inserting a resiliently compressible cylindrical support member into the opening of a longitudinally extending concrete floor joint of similar or lesser cross-demension to lodge the same at and along the opening in order to retain moisture in the curing of the concrete at the joint, while sealing the opening from the entry of debris into the joint; and, following the concrete hardening, pushing the compressed support member to the bottom of the joint to seal the base thereof; and filling the joint above the support member with semi-rigid epoxy filler flush with the concrete surface on each side of the joint; the hardness of the compressed support member being substantially matched to the hardness of the epoxy filler to prevent any substantial depression of the filler as vehicle wheels ride over the filled joint.

Preferred and best mode designs and constructions are hereinafter set forth.

DRAWINGS

The invention will now be described with reference to the accompanying drawings, FIG. 1 of which is a fragmentary isometric view of the novel backer rod or tube support device of the invention;

DESCRIPTION OF PREFERRED EMBODIMENT

Figure 1:
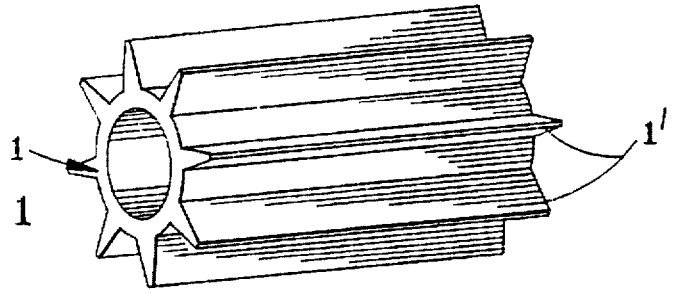

Referring to FIG. 1, the preferred seal and filling support device of the invention is shown in the form of a resilient compressible hollow (tubular) cylindrical strip or rod 1, preferably externally longitudinally ribbed at 1' to provide flexible wiping fins.

Figure 2:
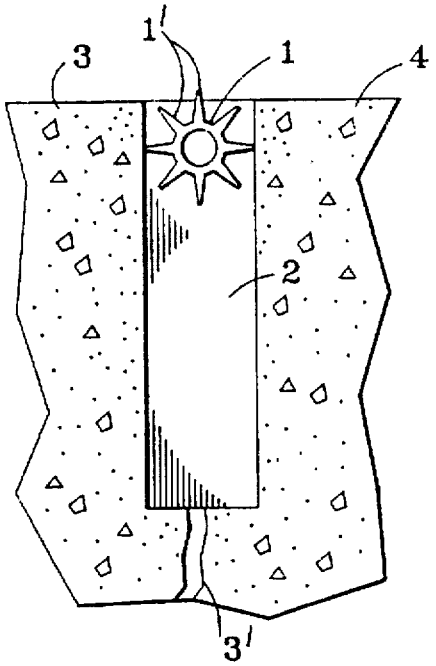
FIG. 2 is a cross-sectional view of the device of FIG. 1 inserted at the top of the concrete floor joint during construction.

The support device 1 is shown in FIG. 2 compressibly inserted or lodged into the top opening of a similar or lesser cross-dimension longitudinally extending cut or joint 2 formed in the concrete floor 3–4 during the construction phase. The support rod cross dimension is preferably slightly greater than the joint opening width to insure a snug, secure fit. As earlier stated, this top sealing serves as an aid in moisture retention, normally lost through open joint venting, enabling an increase in joint edge strength by such moisture retention, and reducing or delaying joint edge curling. In this position, moreover, the device 1 acts as a temporary joint blocker or filler during construction to prevent entry of construction dirt and debris and floor coatings or other contaminents into the joint.

Figure 3:
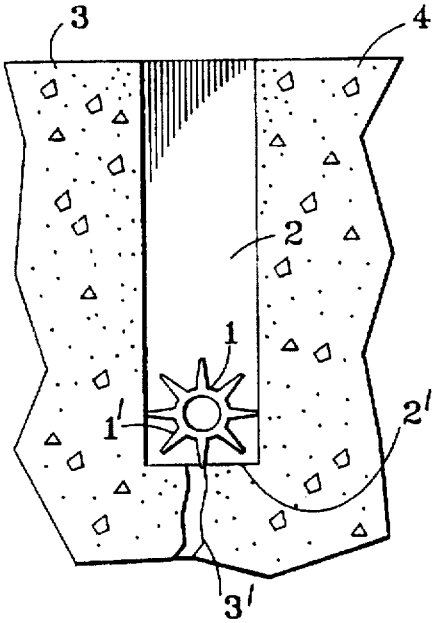
FIG. 3 is a similar view of the device compressed and forced to the bottom of the joint.
Figure 4:
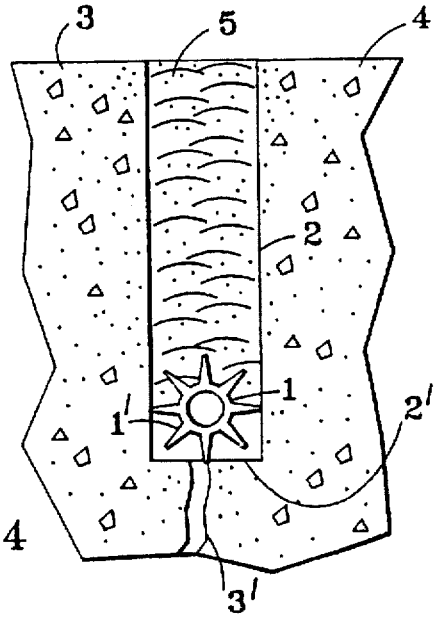
FIG. 4 is a similar view of the epoxy filled joint and compressed device sealing the bottom of the joint and supporting the epoxy filling.

When the concrete has cured and cracks 3' are forced to occur below the intentional joint cuts 2, as previously mentioned the support device 1 is pushed under compression into the joint 2 and down to and along its base or bottom wall 2', FIG. 3, with the tubular device compressed and the fins or ribs 1' of the compressible tubular support 1 resiliently wiping clean the joint side walls during insertion, and then sealing the base wall along its extent. The epoxy filler 5 is then inserted into the joint on top of the compressed and bottomed support 1 that now seals the base wall 2' from epoxy filler material entering the cracks 3'. The epoxy is filled flush with the upper surface of the concrete floor 3–4, with the joint edges contiguous and sealed to the epoxy and thus unexposed to abrasion.

By matching the hardness of the compressed support 1 to that of the preferably semi-rigid flexibilized epoxy filler 5, such as the before-mentioned type MM80 (a two component resin-and-hardner epoxy having a resin part of diglycidyl ether of bisphenol-A, aliphatic triglyceride triglycidyl ether resin and epichlorohydrin, and a hardner part of polyethylene polyamine and modified polyethylene polyamine adduct with epoxy and fatty acid), the filler will stay fixed and resist the impact pressure of vehicle wheels and the like substantially without depressing, thereby protecting the joint edges sealed to the upper surface of the epoxy joint from exposure.

For conventional saw cuts in the layed concrete floor, the support device 1 of the invention should preferably be inserted immediately after the cutting operation is performed. With "Soff-Cut®" sawn joints, the insertion should take place as soon as the concrete has hardened sufficiently to avoid damage due to support rod device insertion pressure. For construction (formed) joints, the insertion is preferably made as soon as the joint is wide enough to accept the support end.

Excellent results have been obtained with a compressible polyvinyl chloride tube device 1 composited to have a hardness of the order of about 90 on the Shore Hardness Scale A, used with such "MM80" epoxy filler of hardness of the order of about 80 to 90 on said scale. The support tubes 1 were formed for different corresponding cross-dimension joint openings ranging from about ⅛" to ⅜", and possibly larger, with the fins having a radial length of about 15% of the outside diameter, and the inner hollow of the tube, a diameter of about 25% of the outside diameter. The ¼" outer diameter sizes are useful for joints between 3/16" and ¼"; 3/16" outer diameter rods, for joints ⅛" to 3/16" wide; and the ⅛" rods for "Soff-Cut®" and other narrow joints.

The base rod or tube support of the invention has been found capable of supporting other commercial semi-rigid epoxy fillers, as well, as of the condensation products of epichlorhydrin and diphenylolpropane (as described, for example) on pages 280–283 of Chemical Materials For Construction, by Philip Marslow Structures Publishing Co., 1974, Library of Congress Catalog Card No. 73-85217), admirably preventing epoxy loss through the bottom of the joint, eliminating mess and depth guessing as with sand, and providing for fast and simple insertion that enables higher filling production rates. The combined savings of less epoxy and faster filler installation, indeed, has been found to equal or exceed the cost of the support rod itself.

While a tubular construction is preferred for increased compressibility and compressed hardness, and some has lesser cost as well, solid rods may be used in some applications. Though the use of fins provides the added advantages before discussed, in some applications the rod support may be smooth. As previously stated, polyvinyl chloride tubes are deemed the preferred material, but other resiliently compressible plastic strips may also be used; and further modifications will also ocurr to those skilled in this art, such being considered to fall within the spirit and scope of the invention as defined in the appended claims.

What is claimed is:

1. For use in sealing and supporting fillings in longitudinally extending concrete floor joints and the like having joint openings extending from opening tops down to closed bottoms thereof, a resiliently compressible longitudinally extending cylindrical support member externally provided with at least one compressible wiping surface protruding externally of the cylindrical support member and extending at a slightly larger cross-section than that of the joint openings with which the support member is intended to be used; the protruding wiping surface being adapted such that, when the support member is resiliently compressed and inserted to lodge the support member at the top of the joint opening in order to retain moisture in the curing of the concrete at the joint opening, the compressed protruding wiping surface seals the opening from the entry of debris into the joint, the support member being adapted, following the concrete hardening, resiliently compressibly to slide down the joint opening and along the bottom thereof so that the compressed member and its protruding wiping surface will seal the bottom; and the compressed support member having hardness sufficient to support similarly hard semi-rigid filler filling the joint above the bottom so as to prevent substantial depression of the filler as vehicle wheels ride over the filled joint; wherein said at least one protruding wiping surface comprises a plurality of wiping surfaces and in which the protrusion wiping surfaces comprise integral resiliently compressible external ribs longitudinally extending along the exterior of the cylindrical support member and circumferentially transversely spaced about the circumference at top, bottom and sides of the cylindrical support member.

2. A resiliently compressible cylindrical support member as claimed in claim 1 and in which the cylindrical support member is tubular.

3. A resiliently compressible cylindrical support as claimed in claim 1 of polyvinyl chloride.

4. For use in sealing and supporting fillings in longitudinally extending concrete floor joints and the like having joint opening extending from openings tops down to solid closed bottoms thereof; a one-piece resiliently compressible longitudinally extending cylindrical support member integrally externally surfaced to provide at least one externally protruding compressible wiping surface and of slightly larger cross-section than that of the joint opening into the top of which the support member with its external protruding wiping surface is intended to be compressibly inserted; the support member and its protruding wiping surface being sufficiently resiliently compressible to enable the member to be pushed all the way down the opening, which the compressed protruding wiping surfaces wipe the joint, and ultimately to seal along the bottom thereof from entry of debris and seepage into the joint wherein said at least one protruding wiping surface comprises a plurality of wiping surfaces and in which the support member is hollow, and the protruding wiping surfaces are radially directed longitudinally extending resiliently compressible ribs disposed transversely circumferentially substantially uniformly about the complete circumference of the support member at top, bottom and sides.

5. A cylindrical support member as claimed in claim 4 wherein said at least one protruding wiping surface comprises a plurality of wiping surfaces integral with but spaced from one another externally about the support member at top, bottom and sides.

* * * * *